US007028944B2

(12) United States Patent
Lindner

(10) Patent No.: US 7,028,944 B2
(45) Date of Patent: Apr. 18, 2006

(54) TAKE-UP DEVICE FOR WEB-SHAPED MATERIALS, ESPECIALLY PLASTIC FILMS

(75) Inventor: Paul Lindner, Henndorf (AT)

(73) Assignee: Brückner Maschinenbau GmbH, Siegsdorf (DE)

( * ) Notice: Subject to any disclaimer, the term of this patent is extended or adjusted under 35 U.S.C. 154(b) by 83 days.

(21) Appl. No.: 10/697,964

(22) Filed: Oct. 31, 2003

(65) Prior Publication Data

US 2004/0108405 A1 Jun. 10, 2004

(30) Foreign Application Priority Data

Oct. 31, 2002 (DE) ..... 102 50 863

(51) Int. Cl.
*B65H 18/26* (2006.01)

(52) U.S. Cl. ..... 242/547; 242/534

(58) Field of Classification Search ..... 242/547, 242/534, 534.1

See application file for complete search history.

(56) References Cited

U.S. PATENT DOCUMENTS 3,648,342 A * 3/1972 Dorfel ..... 242/547
4,095,755 A * 6/1978 Snygg et al. ..... 242/541.6
5,785,271 A * 7/1998 Leskinen et al. ..... 242/530.1
5,806,783 A * 9/1998 Turunen ..... 242/530.1
6,182,919 B1 * 2/2001 Fisher et al. ..... 242/547
6,659,388 B1 * 12/2003 Frank et al. ..... 242/530.1

FOREIGN PATENT DOCUMENTS

| | | |
|---|---|---|
| DE | OFF 41 03 799 A1 | 8/1992 |
| DE | OFF 198 05 412 A1 | 8/1999 |
| DE | 198 11 093 | 9/1999 |
| WO | WO 97/39971 | 10/1997 |

* cited by examiner

*Primary Examiner*—Kathy Matecki
*Assistant Examiner*—Sang Kim
(74) *Attorney, Agent, or Firm*—Nixon & Vanderhye P.C.

(57) ABSTRACT

In the take-up device for web-shaped materials, especially plastic films, there is at least one bearing unit which acts between the ends of the contact roller on its peripheral compressive surface and supports the contact roller. The contact roller is made with a relatively small diameter and is made flexurally soft such that via the bearing unit(s) the bending line and the damping behavior of the contact roller between its ends can be influenced and advantageously also controlled.

19 Claims, 3 Drawing Sheets

TAKE-UP DEVICE FOR WEB-SHAPED MATERIALS, ESPECIALLY PLASTIC FILMS

BACKGROUND OF THE INVENTION

The invention relates to a take-up device for web-shaped materials, especially plastic films with a take-up roller and a contact roller which presses the web-shaped material against the take-up roller.

Especially in the manufacture of plastic films, the plastic film webs which are stretched in a stretching system in the transverse and lengthwise direction are ultimately wound onto a take-up roller. A contact roller which presses the film layer which is outermost at the time against the rolled bale which has been wound so far is in compressive contact with the take-up roller or the rolled bale.

The known contact rollers are conventionally supported on the two roller ends. According to the working width, the required contact compressive forces and the necessary operating rpm, the diameter of the contact roller is chosen such that the desired stiffness is obtained and sagging is prevented as much as possible. At working widths from 8 to 10 m the diameter of conventional contact rollers is often more than 600 mm.

Contact rollers with large diameters however have a correspondingly great weight; this among others has an adverse effect on their dynamics and increases the friction in the bearings. Furthermore, for large diameters the contact surface which is flattened by Hertzian stress between the contact roller and the rolled bale increases so that only a limited pressure build-up is enabled on the rolled bale or very high compressive forces must be used. Furthermore the compressive force of the contact rollers with large diameters can only be influenced little over the working width and damping is sufficiently possible only on the ends of the contact roller. Large working widths have the disadvantage that the compressive force in the middle of the roller is generally too small to reliably prevent air inclusions between the individual wound layers of the take-up roller. These air inclusions however lead to nonuniform build-up of the rolled bale. Furthermore, for large working widths of the contact roller in the roller middle, running is often rough, so that concentricity is adversely affected. Problems arise with the desired width preservation effect since the material web is not uniformly pulled over its width, but is tensioned more tautly in the middle area than in the edge areas so that in this way a nonuniform build-up of the rolled bales and different hardness over the width of the rolled bale occur. In general, for the known contact rollers acquisition of information about the quality of the rolled bale is only possible to a limited degree over the ends of the contact roller.

SUMMARY OF THE INVENTION

Therefore the object of the invention is to devise a take-up device with a contact roller which enables improved rolled bale quality, especially for large working widths and high winding speeds.

In the take-up device of the invention there is at least one bearing unit which acts between the ends of the contact roller on its peripheral compressive surface and supports the contact roller, this bearing unit being adjustable in at least two directions which run perpendicular to one another. Furthermore the contact roller is made flexurally soft such that by moving at least one bearing unit the bending line of the contact roller can be influenced in a purposeful manner. The diameter of the contact roller is preferably a maximum 550 mm, especially a maximum 400 mm when its working width is more than 8 m; a maximum 400 mm, especially a maximum 300 mm, when its working width is between 3 and 8 m; and a maximum 200 mm when its working width is less than 3 m.

In contrast to known contact rollers which are made as stiff as possible for large working widths and therefore with large diameters, the contact roller of the invention is made relatively flexurally soft and has a small diameter. This is enabled by the additional bearing units which act between the ends of the contact roller on its peripheral compressive surfaces and they therefore support these points. Feasibly there are several of these bearing units. As a result of the flexurally soft execution of the contact rollers its bending line can be influenced over its entire working width such that there is an optimum uniform pressure distribution over the working width of the contact roller, and thus along the entire working widths a defined contact pressure is applied to the take-up roller or the rolled bale. In particular, with respect to the width preservation effect, the bending line of the contact roller can be influenced in a purposeful manner such that the tensile stress on the material web is uniform in the edge areas and in the middle area, by which a high quality of the rolled bale and uniform hardness of the rolled bale over the entire bale width can be achieved. As a result of the smaller diameter and lower weight of the contact roller, it has improved dynamic behavior so that it is especially suited even for high take-up speeds. The load on the bearings is reduced. Furthermore, the reduced roller diameter yields a smaller Hertzian contact surface between the contact roller and the rolled bale so that high contact pressures can be achieved even with lower forces. The additional bearing units between the roller ends make it possible to obtain data for measuring the rolled bale quality and for adaptive damping. Thus it is possible to detect vibrations, especially also due to the natural resonance of the contact roller, and to adapt the damping accordingly. Furthermore, adaptive damping over the entire working width and not only on the roller ends is possible. The number of bearing units between the roller ends also enables improved damping of the contact roller in the middle area. The additional support of the contact roller in the roller middle furthermore causes improved concentricity in the roller middle and a considerable rise of the critical rpm. The load on the contact roller bearing due to rough running is greatly reduced.

The number of bearing units over the working width is determined according to the necessary contact pressure, the bending line, the rpm, the dynamics, the overload, etc. Furthermore, by evaluating the manipulated variables the hardness of the rolled bale, lack of roundness and flexing work can be detected and influenced in sections over the working width. In this case the flexing work of the contact roller or of the rolled bale and the deviation from the theoretical manipulated variables of the actuation path and contact force are evaluated. Diameter differences over the working width can likewise be detected. Because the additional bearing unit(s) located between the end-side bearings support the contact roller on the peripheral compressive surface, there are no interruptions in the peripheral compressive surface of the contact roller.

The adjustability of the bearing unit(s) in at least two directions which run perpendicular to one another is intended to mean that the bearing unit is adjustable in the horizontal direction, i.e. in the direction to the take-up roller toward or away from it, and in the vertical direction, i.e. at an angle of 90° to the horizontal direction. In addition, the bearing unit can also be adjustable in the axial direction of the contact roller.

Based on the aforementioned possible embodiments and advantages, the contact roller in the invention is thus especially suitable for large working widths which can be for example 10 m and more, and for high take-up speeds.

According to one advantageous embodiment there are sensor means which detect the position, path, force and/or acceleration of the contact roller over the bearing units. Furthermore, there is preferably a control means which controls the adjustment of the bearing unit(s) and thus the setting of the bending line and/or damping of the contact roller depending on the data acquired by the sensor means. In this case there is thus a closed control circuit for support of the contact roller over its entire working width, which support is optimized to the compressive force.

It is especially advantageous if along the contact roller there are a plurality of bearing units, preferably at regular intervals, which are adjustable independently of one another in different directions. This yields an especially good possibility for measured data acquisition and for optimized pressure build-up over the entire working width. Furthermore the critical rpm can be accommodated by a sufficient number of bearing units.

Advantageously the contact roller in the area of at least one bearing unit is made more flexurally soft than in the other areas. This can be caused for example by a thinner wall thickness of the contact roller or by a softer material in the area of the support points. Furthermore it is also possible to change the bending stiffness in a purposeful manner with the correspondingly made contact rollers, for example CFK rollers, by changing the fiber structures and density and/or by changing the resin, its composition, density, etc. In this way, on the one hand, detection of the state of the contact roller and on the other the influencing of this state are possible in an especially effective manner.

It is especially advantageous if at least one bearing unit consists of an air or magnetic bearing. In this way a low, constant friction of the bearing system is ensured.

According to one advantageous embodiment the bearing unit comprises a vertical bearing segment which vertically supports the contact roller and a horizontal bearing segment which horizontally supports the contact roller and which is movably guided in or on the vertical bearing segment. Such a bearing unit thus represents a combination bearing for horizontal and vertical support of the contact roller in which the vertical bearing segment and the horizontal bearing segment are located in the immediate vicinity of one another. For example, the vertical bearing segment and the horizontal bearing segment can be internested interdigitally. This yields a greater overlap of the bearing segments over the periphery of the contact rollers, for example over a periphery of 220–300° which enables especially exact guidance of the contact roller and improved evaluation and influencing of the running properties.

Preferably there is a base support which is located parallel to the contact roller and in or on which the vertical bearing segment can move vertically and is supported floating in the horizontal direction. The floating support on the one hand contributes to damping and constitutes on the other hand also a safety factor since when the load changes for example by tearing, idle running without a web of material, larger tension fluctuations, etc. self-adjustment is enabled.

A complete embodiment which is relatively simple to implement arises when the horizontal bearing segment is made piston-like and can be adjusted in the direction of the contact roller by a horizontal actuator which acts between the base support and the horizontal bearing segment.

It is especially preferable when on the one hand between the vertical bearing segment and the base support and on the other hand also between the horizontal bearing segment and the base support there are sensor means for detecting the bearing forces, position and/or vibrations of the vertical bearing segment and the horizontal bearing segment.

Advantageously, in the middle area of the contact roller there are more bearing units than toward the ends of the contact roller. In this way the contact pressure of the contact roller can be optimized especially effectively and quickly to the take-up roller especially in the middle area.

According to one advantageous embodiment at least one bearing leg is pivotally located on the retaining arm of the vertical bearing segment. This enables the bearing leg to be folded up if the material web in case of a fault has been pulled into the bearing gap, and thus improved accessibility of the contact roller.

The invention is detailed below using the drawings by way of example.

DETAILED DESCRIPTION OF THE INVENTION

Figure 1:
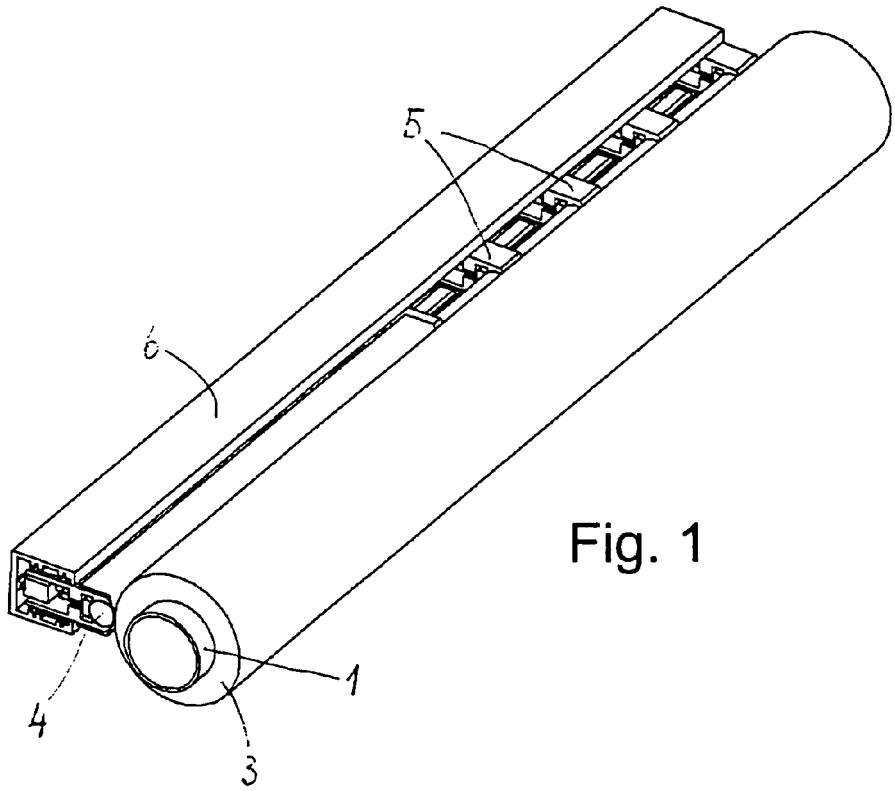
FIG. 1 shows a perspective, partially cutaway view of the winding device of the invention.
Figure 2:
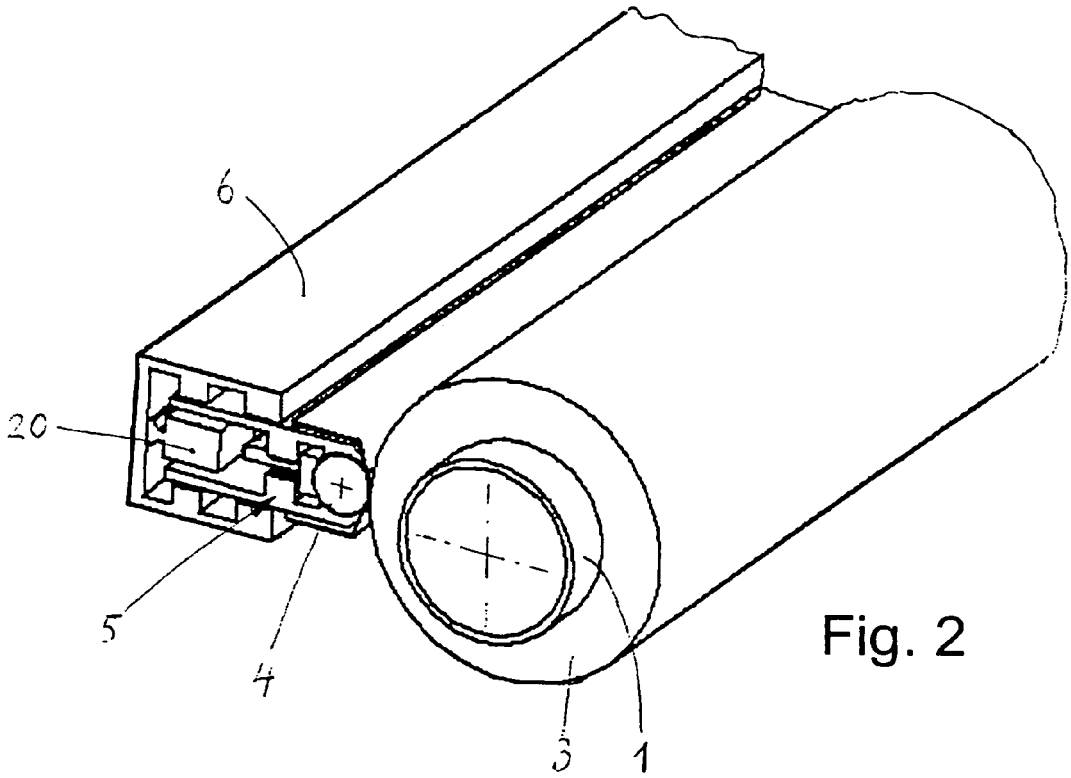
FIG. 2 shows an enlarged representation of the front part of the take-up device from FIG. 1.

FIGS. 1 and 2 show a take-up roller 1 on which a web-shaped material 2 (FIG. 3) is wound into a rolled bale 3. Parallel to the take-up roller 1 runs a contact roller 4 which during the take-up process is in continuous compressive contact with the rolled bale 3 and presses the arriving web-shaped material 2 against the layer of the winding bale 3 which is outermost at the time. The contact roller 4 extends with a constant diameter over the entire length of the rolled bale 3 and is used to take up the web-shaped material 2 as uniformly as possible.

The take-up roller 1 is pivotally supported on its two ends by means of an end-side bearing which is not shown.

A contact roller 4 is pivotally supported on its two ends likewise via end-side bearings which are not shown. In addition to these end-side bearings the contact roller 4 however has a plurality of bearing units 5 which are located between the end-side bearings at a regular interval to one another and have a support, compressive, damping and sensor function for the contact roller 4. Based on these additional bearing units 5 it is possible to make the contact roller 4 even for large working widths with a relatively small diameter and relatively flexurally soft so that the relative position to the rolled bales 3 and the contact pressure can be set by individually triggering of the individual bearing units in segments via the working width. For example, at a working width of 10 m and four additional bearing units 5 between the end-side bearings the diameter of the contact roller 4 is only 150 mm to 250 mm.

The bearing units 5 are movably supported horizontally and vertically in a common base support 6. The base support 6 extends parallel to the take-up roller 1 over its entire working width. Furthermore, the base support 6 consists of a box-shaped hollow section with an essentially rectangular cross section. On its side facing the take-up roller 1 the base support 6 has openings through which the bearing units 5 extend.

The bearing units 5 in this embodiment consist of air bearings, but can also consist of magnetic bearings. Each bearing unit 5 consists, as is especially apparent from FIGS. 3 and 4, of the vertical bearing segment 7 with which the contact rollers 4 are supported from overhead and from underneath, i.e. in the vertical direction, and a horizontal bearing segment 8 which presses from the side of the base support 6 in the horizontal direction against the contact roller 4 and thus presses it against the take-up roller 1 and the rolled bale 3.

Each vertical bearing segment 7 consists of an upper bearing leg 7*a* and a lower bearing leg 7*b*. They are detailed in FIG. 4, in this figure the contact roller 4 being shown cutaway in order to be able to recognize more clearly its structure using the rear bearing unit 5.

The upper bearing leg 7*a* and the lower bearing leg 7*b* are made the same, but are arranged mirror-symmetrically to one another. The bearing legs 7*a*, 7*b* each have a horizontally arranged retaining arm 9 in the form of a flat elongated plate which extends into the base support 6 and is supported there in a manner which will be detailed later. From the retaining arm 9 there extend two bearing fingers 11 which are separated from one another by a center lengthwise groove 10 over or under the contact roller 4. The end area of the bearing finger 11 which faces the contact roller 4 has a concave bearing surface 12 which is arc-shaped in cross section and which has a curvature which is matched to that of the contact roller 4 so that a constant air bearing gap results between the bearing surface 12 and the contact roller 4. In this case the two bearing surfaces 12, the bearing legs 7*a*, 7*b* extend by 85° each in the peripheral direction of the contact roller 4, the middle of the bearing surfaces 12 lying above or below the middle point of the contact roller 4.

The retaining arms 9 are supported to float horizontally by means of outside bearings 13 in an intermediate support 14. The vertical bearing segment 7 can thus move in the horizontal direction, as indicated by the double arrow 15, but is fixed in the vertical direction in the intermediate support 14.

The intermediate support 14 on its outside has vertically projecting guide crosspieces 16 which fit into the corresponding vertical guide grooves 17 which are located on the inside of the base support 6. The intermediate support 14 is thus supported to be horizontally stationary, but vertically movable within the base support 6.

Figure 3:
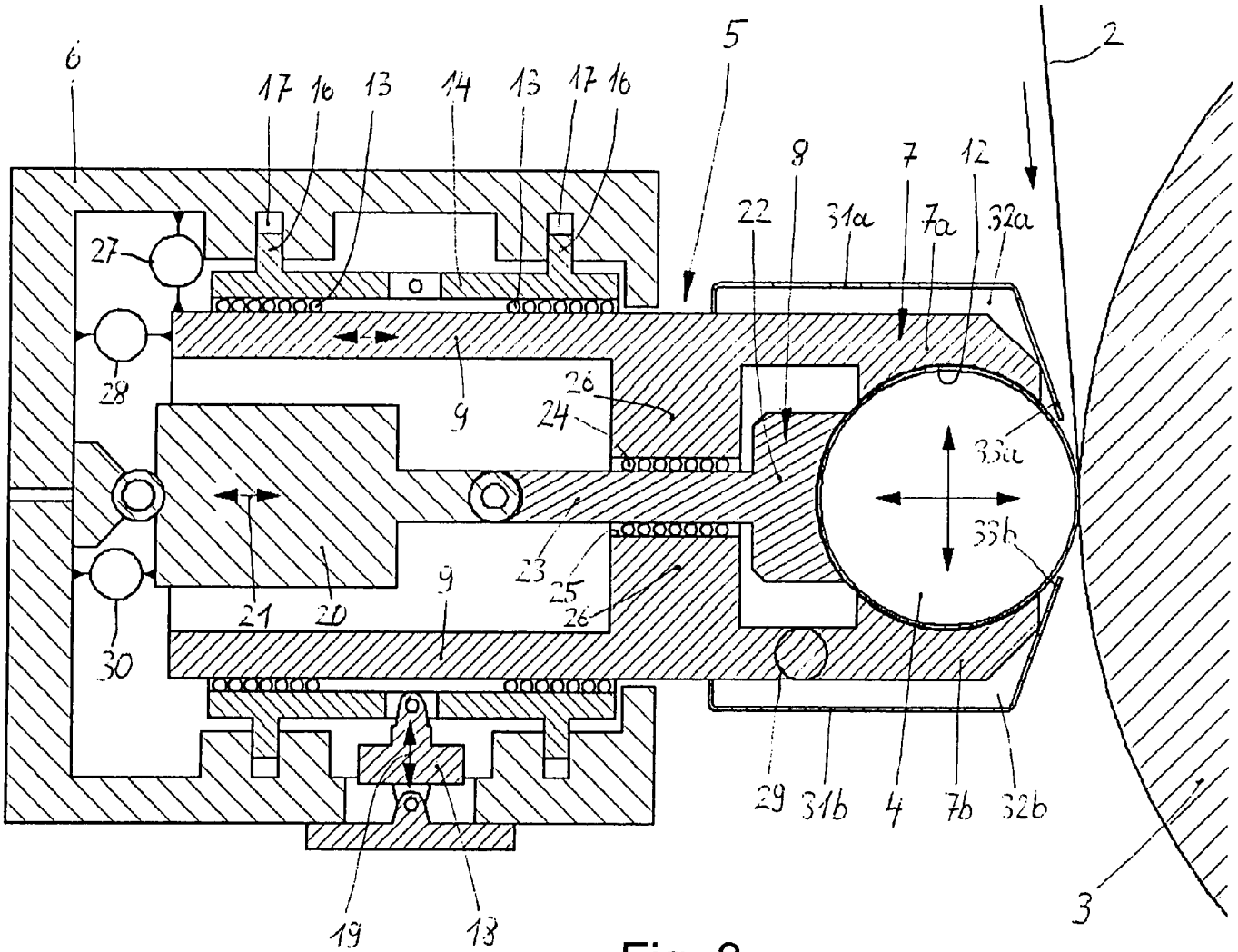
FIG. 3 shows a vertical section through the take-up device from FIG. 1.

The vertical displacement of the intermediate support 14 and thus of the vertical bearing segment 7 takes place by means of a vertical actuator 18 which is shown only schematically in FIG. 3 and which can be any suitable, for example, mechanical, hydraulic, electromechanical, linear-motorized or pneumatic lifting means. The vertical actuator 18 is on the one hand dynamically connected to the base support 6 and on the other to an intermediate support 14 and can execute vertical motion in the direction of the double arrow 19.

Advantageously, in order to prevent tilting motion of the intermediate support 14, both on its upper side and also on its lower side there are two horizontally spaced guide crosspieces 16 which fit into the horizontally spaced guide grooves 17 of the base support 6 which are arranged accordingly.

Between the upper bearing leg 7*a* and the lower bearing leg 7*b* there is a clear space which is used to hold the horizontal bearing segment 8 and the horizontal actuator 20 which on the one hand engages the horizontal bearing segment 8 and on the other the base support 6 and the horizontal bearing segment 8 in the horizontal direction, i.e. in the direction to the rolled bale 3, or can move away from it. This is illustrated by the double arrow 21.

The horizontal actuator 20 can be a device which enables both coarse adjustment and also fine adjustment. For coarse adjustment, i.e. for adjustment of the horizontal bearing segment 8 in the range of one or more millimeters an electromechanical device in the form of a small lifting cylinder can be used. For fine adjustment in the 1/10 millimeter range which is done especially for fine adjustment of the contact pressure line and damping, conversely a highly dynamic means 40 is used which operates for example with piezoelements or a small linear motor. In this way it is possible to adjust the contact pressure of the horizontal bearing segments 8 against the contact roller 4 and thus that of the contact roller 4 against the rolled bale 3 in a highly dynamic manner.

The horizontal bearing segment 8 consists of a bearing head 22 with a concavely curved surface with curvatures which correspond to those of the contact roller 4 and which extend over an angular range of 75° with a constant distance to the contact roller 4 over its periphery. This constant distance is used in turn as the air bearing gap.

From the bearing head 22 there extends a center guide shaft 23 in the horizontal direction to the horizontal actuator 20. The guide shaft 23 is supported to be able to move by means of a bearing 24 in the horizontal direction in a middle guide opening 25 which is made between the inner projections 26 of the upper and lower bearing leg 7*a*, 7*b*.

Figure 4:
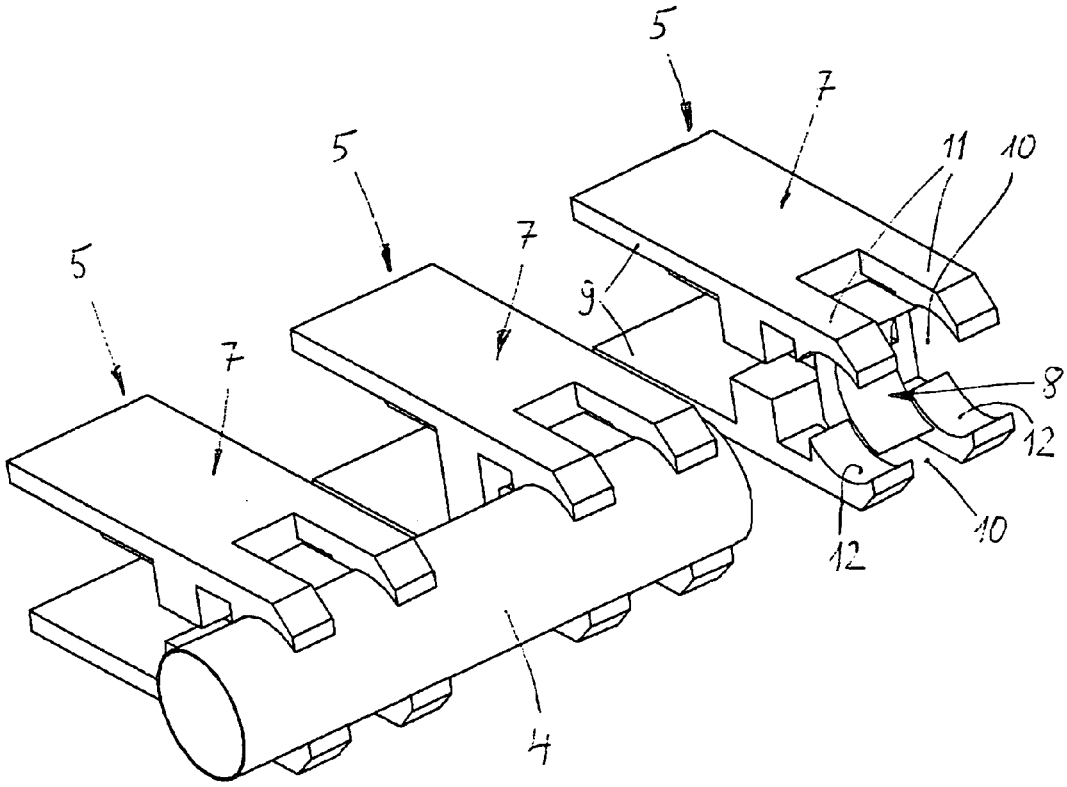
FIG. 4 shows a perspective of three bearing units and the cut-off contact roller.

As is apparent from FIG. 4, the bearing head 22 has a width which is only somewhat less than the width of the groove 10 between the bearing fingers 11 so that the bearing head 22 can move into this groove 10 with relatively little lateral play. The bearing surface of the bearing head 22 is thus located in the immediate vicinity of the bearing surfaces 12 of the bearing fingers 11. The bearing head 22 and the bearing fingers 11 thus fit interdigitally into one another, or in other words, are internested interdigitally. In this way there is relatively great overlap of the contact roller 4 over the periphery in the area of a certain bearing site, only the remaining area of the contact roller 4 facing the rolled bale 3 not being overlapped.

Between the back end of the vertical bearing segment 7 and the base support 6 there are furthermore sensor means for detecting the force, path and vibrations in the vertical or horizontal direction. One such sensor means 29 can also be located in that area of the vertical bearing segment 7 which is located outside the base support 6.

Another sensor means 30 for detecting the horizontal force, path and vibrations is provided between the back end of the horizontal actuator 20 and the base support 6.

As is furthermore apparent from FIGS. 1 to 3, in the area between the base support 6 and the rolled bales 3 there is a blow box with air baffle plates 31*a*, 31*b* which border an upper and lower air guide channel 32*a*, 32*b* to the outside. The ends 33*a*, 33*b* of the air baffle plates 31*a*, 31*b* facing the rolled bales 3 end near the inlet or outlet gap between the contact roller 4 and the rolled bale 3 with a short distance to the contact roller 4. When a new material web is placed on the take-up roller 1 and when a material web tears during production, in the air guide channel 32*a* an overpressure is produced so that the air flowing out in the area of the ends 33*a*, 33*b* of the air baffle plates 31*a*, 31*b* presses the web-like material 2 against the take-up roller 1. Conversely, during normal production, in the air guide channel 32*a* a negative pressure is produced so that the web-shaped material 2 is first sucked against the contact roller 4 and it is ensured that the incoming web-shaped material 2 is pressed by the contact roller 4 properly against the layer of the rolled bale 3 which is outermost at the time. In the area of the lower air guide channel 32*b* conventionally in general an overpressure is built up so that the air extending along the contact roller 4 even in the case of a tear ensures that the web-shaped material 2 is not pulled into the air gap between the vertical bearing segment 7 and the contact roller 4.

Figure 5:
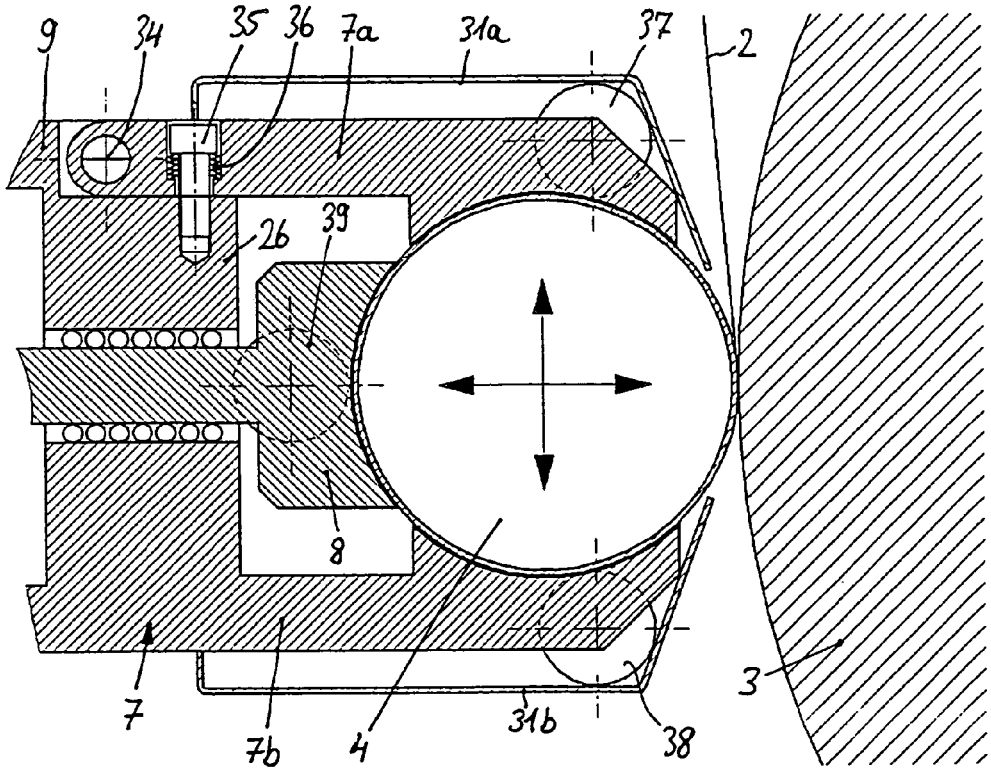
FIG. 5 shows another embodiment of the take-up device of the invention.

FIG. 5 shows a segment of another embodiment of the take-up device of the invention. In this embodiment the upper bearing leg 7*a* of the vertical bearing segment 7 is pivotally mounted on the retaining arm 9 of the vertical bearing segment 7. The swivelling axis runs parallel to the axis of the contact roller 4 and is labelled 34. The bearing leg 7*a* can thus be folded up around the swivelling axis 34 if in case of a fault the material web has been pulled into the upper bearing gap and must be removed from this gap. In the horizontal operating position the bearing leg 7*a* is fixed by screws 35 which are screwed from overhead through the bearing leg 7*a* into the retaining arm 9 in the area of the projection 36. Between the head of the screw 35 and the bearing leg 7*a* there is a spring 36, by which the bearing leg 7*a* is pressed down elastically. If the material web is drawn in or the material web is taken up on the contact roller 4, the upper bearing leg 7*a* can yield elastically up in this way.

FIG. 5 furthermore schematically shows a mechanical back-up system which consists of a top roll 37, a bottom roll 38 and a side roll 39. These rolls 37–39 are pivotally supported in a suitable manner on the base support 6 or another bracket of the take-up device, its axes of rotation running parallel to the axes of rotation of the take-up device 4. Furthermore there are rolls 37–39 in the immediate vicinity of the contact roller 4, the peripheral surfaces of the rolls 37–39 projecting slightly into the bearing gap between the bearing legs 7*a*, 7*b* and the contact roller 4 or into the bearing gap between the bearing head 22 and the contact roller 4 without in normal operation touching the contact roller 4. The rolls 37–39 are used for mechanical support of the contact roller 4 either for a pressure break (pneumatic support) and shutdown of the device or alternatively also to accommodate an overload which is acting on the contact roller 4 during take-up. In the presence of such a mechanical back-up system it is thus possible to design air or magnetic bearings of the contact roller 4 with a lower load margin and thus to use smaller bearings. If the mechanical back-up system is also designed to accommodate the overload during take-up, it advantageously runs concomitantly at the roller speed in order to avoid surface damage.

Furthermore it is also possible to provide a contact roller 4, especially of steel, which is supported at several positions over the working width by short rubber rollers. In principle they can be arranged identically or similarly to the rolls 37–39 which are shown in FIG. 5. These rubber rollers also have positive effect on the service life of the contact roller 4.

The described contact roller thus has the following features and advantages:

- the contact roller is also suited for large working widths of 10 m and more with high take-up speeds, and the diameter of the contact roller can be very small, for example 150–250 mm
- an optimum pressure distribution in the contact area between the contact roller and the rolled bale by reducing the Hertzian contact surface and thus concomitantly increasing the specific pressure
- an optimum pressure distribution over the working width of the contact roller so that the bending line can be easily influenced over the working width
- the contact roller can be relatively flexurally soft in order to detect deviations
- the support of the contact roller is made such that the measurement data can be detected horizontally, vertically and dynamically
- adaptive dampers can not only engage the roller ends, but over the working width between the roller ends
- by air or magnetic bearings a low and constant friction can be ensured; this is a prerequisite for uniform drawing of the film of the system
- the low moving mass of the contact roller facilitates acquisition of measurement data, reduces excitation to vibration and facilitates damping measures
- due to the small diameter of the contact roller an optimized pressure build-up to the rolled bale is possible
- increased system reliability since
  - the critical rpm can be accommodated by a sufficient number of bearing segments
  - the floating support enables self-adjustment for load changes (tearing, idle running without film, greater tension fluctuation, etc.)
  - vertical and horizontal support can be made elastic so that the contact roller in an overload can settle on a mechanical back-up system
  - by applying an overpressure to the intake gaps, in a tear or upon application the film can be prevented from being pulled into the bearing system
- interplay with an upstream tension measurement is possible in which the tensions are measured in several sections over the working width, since accordingly on the contact roller the tension and pressure can be matched in sections
- an assessment of the quality of the rolled bale is possible since by evaluating the manipulated variables of the segmented support the hardness of the rolled bale can be detected in segments over the working width and also the lack of roundness and the diameter difference can be detected over the working width
- adaptive damping is possible since by evaluating the reaction forces of accelerations and the manipulated variables of the individual support segments the necessary data for adaptive damping can be obtained.

Alternatively to the described air bearing system it is also easily possible for the bearing units 5 to consist of magnetic bearings or mechanical bearings.

The invention claimed is:

1. A take-up device for web-shaped materials comprising:

a take-up roller;

a contact roller which presses the web-shaped material against the take-up roller by means of a peripheral compressive surface; and at least one bearing unit which acts between the ends of the contact roller on its peripheral compressive surface and supports the contact roller, wherein said at least one bearing unit is adjustable in at least two directions which run perpendicular to one another, and wherein the contact roller is flexibly supported such that moving said at least one bearing unit causes a bending line of the contact roller to adjust with respect to the web-shaped material.

2. The take-up device as claimed in claim 1, wherein the diameter of the contact roller is:

a maximum 550 mm when its working width is more than 8 m, a maximum 400 mm when its working width is between 3 and 8 m, and a maximum 200 mm when its working width is less than 3 m.

3. The take-up device as claimed in claim 1, further comprising:

sensor means which detect at least one of the position, path, force and acceleration of the contact roller via the at least one bearing unit, and control means which controls the adjustment of the at least one bearing unit and thus the setting of at least one of the bending line and damping of the contact roller depending on the data acquired by the sensor means.

4. The take-up device as claimed in claim 1, wherein along the contact roller there are a plurality of bearing units which are adjustable independently of one another in different directions.

5. The take-up device as claimed in claim 1, wherein the at least one bearing unit is an air or magnetic bearing.

6. The take-up device as claimed in claim 1, wherein the at least one bearing unit comprises a vertical bearing segment which vertically supports the contact roller and a horizontal bearing segment which horizontally supports the contact roller and which is movably guided in or on the vertical bearing segment.

7. The take-up device as claimed in claim 6, wherein the vertical bearing segment and the horizontal bearing segment are interdigitally internested.

8. The take-up device as claimed in claim 6, further comprising a base support which is located parallel to the contact roller, wherein the vertical bearing segment is supported by the base support so as to be vertically movable and floating in the horizontal direction.

9. The take-up device as claimed in claim 8, wherein within the base support there is an intermediate support for the vertical bearing segment with a vertical movement capacity, in which the vertical bearing segment is fixed vertically and is supported to float horizontally, and wherein between the base support and the intermediate support a vertical actuator is active in order to keep the intermediate support in a certain vertical position.

10. The take-up device as claimed in claim 6, wherein the vertical bearing segment has two bearing legs which support the contact roller from opposing sides and between which the horizontal bearing segment can be moved.

11. The take-up device as claimed in claim 10, wherein each bearing leg has two spaced bearing fingers between which the horizontal bearing segment can be moved.

12. The take-up device as claimed in claim 10, wherein at least one bearing leg is located to be able to swivel on a retaining arm of the vertical bearing segment.

13. The take-up device as claimed in claim 6, wherein the horizontal bearing segment is reciprocally movable and can be adjusted in the direction of the contact roller by a horizontal actuator which acts between the base support and the horizontal bearing segment.

14. The take-up device as claimed in claim 6, wherein between the vertical bearing segment and the base support there are sensor means for detecting at least one of the bearing forces, position and vibrations of the vertical bearing segment.

15. The take-up device as claimed in claim 6, wherein between the horizontal bearing segment and the base support there are sensor means for detecting at least one of the bearing forces, position and vibrations of the horizontal bearing segment.

16. The take-up device as claimed in claim 1, wherein the at least one bearing unit is adjustable in an axial direction of the contact roller.

17. The take-up device as claimed in claim 1, wherein in a middle area of the contact roller than toward the ends of the contact roller.

18. The take-up device as claimed in claim 1, wherein the contact roller is supported at several positions over the working width by bearing units in the form of short rubber rollers.

19. The take-up device as claimed in claim 1, wherein the diameter of the contact roller is:

a maximum of 400 mm when its working width is more than 8 m, a maximum of 300 mm when its working width is between 3 m and 8 m, and a maximum of 200 mm when its working width is less than 3 m.

* * * * *